US008588652B2

(12) United States Patent
Ohmori et al.

(10) Patent No.: US 8,588,652 B2
(45) Date of Patent: Nov. 19, 2013

(54) CHARGED PARTICLE GENERATOR, CHARGING DEVICE, AND IMAGE FORMING APPARATUS

(75) Inventors: Masao Ohmori, Kanagawa (JP); Takanori Morino, Kanagawa (JP); Chikaho Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 13/032,112

(22) Filed: Feb. 22, 2011

(65) Prior Publication Data

US 2012/0051790 A1 Mar. 1, 2012

(30) Foreign Application Priority Data

Sep. 1, 2010 (JP) ..... 2010-195319

(51) Int. Cl.
*G03G 15/02* (2006.01)

(52) U.S. Cl.
USPC ..... 399/168; 399/115

(58) Field of Classification Search
USPC ..... 399/50, 107, 110, 115, 168–173; 250/325; 315/162, 169.1, 324, 326
See application file for complete search history.

(56) References Cited

U.S. PATENT DOCUMENTS 5,666,605 A * 9/1997 Tokimatsu et al. ..... 399/173
5,970,287 A * 10/1999 Yamaguchi ..... 399/168
7,995,952 B2 * 8/2011 Pan et al. ..... 399/168

FOREIGN PATENT DOCUMENTS

JP A-2010-49857 3/2010

* cited by examiner

*Primary Examiner* — Hoan Tran
(74) *Attorney, Agent, or Firm* — Oliff & Berridge, PLC

(57) ABSTRACT

A charged particle generator includes a first electrode, a second electrode, and an insulating material that is provided between the first electrode and the second electrode. The second electrode has an opening that opens in a first direction in which the first electrode, the insulating material, and the second electrode are arranged. The insulating material has a region limiting space. The region limiting space corresponds to the opening. The region limiting space is continuous with the opening. The region limiting space is a space that opens in a direction in which the region limiting space is oriented toward the opening and that is limited in a second direction perpendicular to the first direction. The first electrode has an anisotropic resistance portion in which a resistance component in the first direction is smaller than a resistance component in the second direction.

6 Claims, 6 Drawing Sheets

CHARGED PARTICLE GENERATOR, CHARGING DEVICE, AND IMAGE FORMING APPARATUS

CROSS-REFERENCE TO RELATED APPLICATIONS

This application is based on and claims priority under 35 USC 119 from Japanese Patent Application No. 2010-195319 filed Sep. 1, 2010.

BACKGROUND (i) Technical Field

The present invention relates to a charged particle generator, a charging device, and an image forming apparatus.

(ii) Related Art

As a scheme for charging an image carrier of an image forming apparatus, a scorotron charging scheme utilizing corona discharge is used in some cases. In the scorotron charging scheme, a member to be charged is charged in a non-contact manner. As another charging scheme, a charging-roller scheme in which a charging process is performed by causing discharge to occur in a very small spacing that is generated between a semiconducting charging roller and an image carrier when the charging roller rotates in contact with the image carrier is used in some cases.

SUMMARY

According to an aspect of the invention, there is provided a charged particle generator including a first electrode, a second electrode, and an insulating material that is provided between the first electrode and the second electrode. The second electrode has an opening that opens in a first direction in which the first electrode, the insulating material, and the second electrode are arranged. The insulating material has a region limiting space. The region limiting space corresponds to the opening. The region limiting space is continuous with the opening. The region limiting space is a space that opens in a direction in which the region limiting space is oriented toward the opening and that is limited in a second direction perpendicular to the first direction. The first electrode has an anisotropic resistance portion in which a resistance component in the first direction is smaller than a resistance component in the second direction.

BRIEF DESCRIPTION OF THE DRAWINGS

Exemplary embodiment(s) of the present invention will be described in detail based on the following figures, wherein.

DETAILED DESCRIPTION

First Exemplary Embodiment

Exemplary embodiments of the present invention will be described with reference to the drawings.

Figure 1:
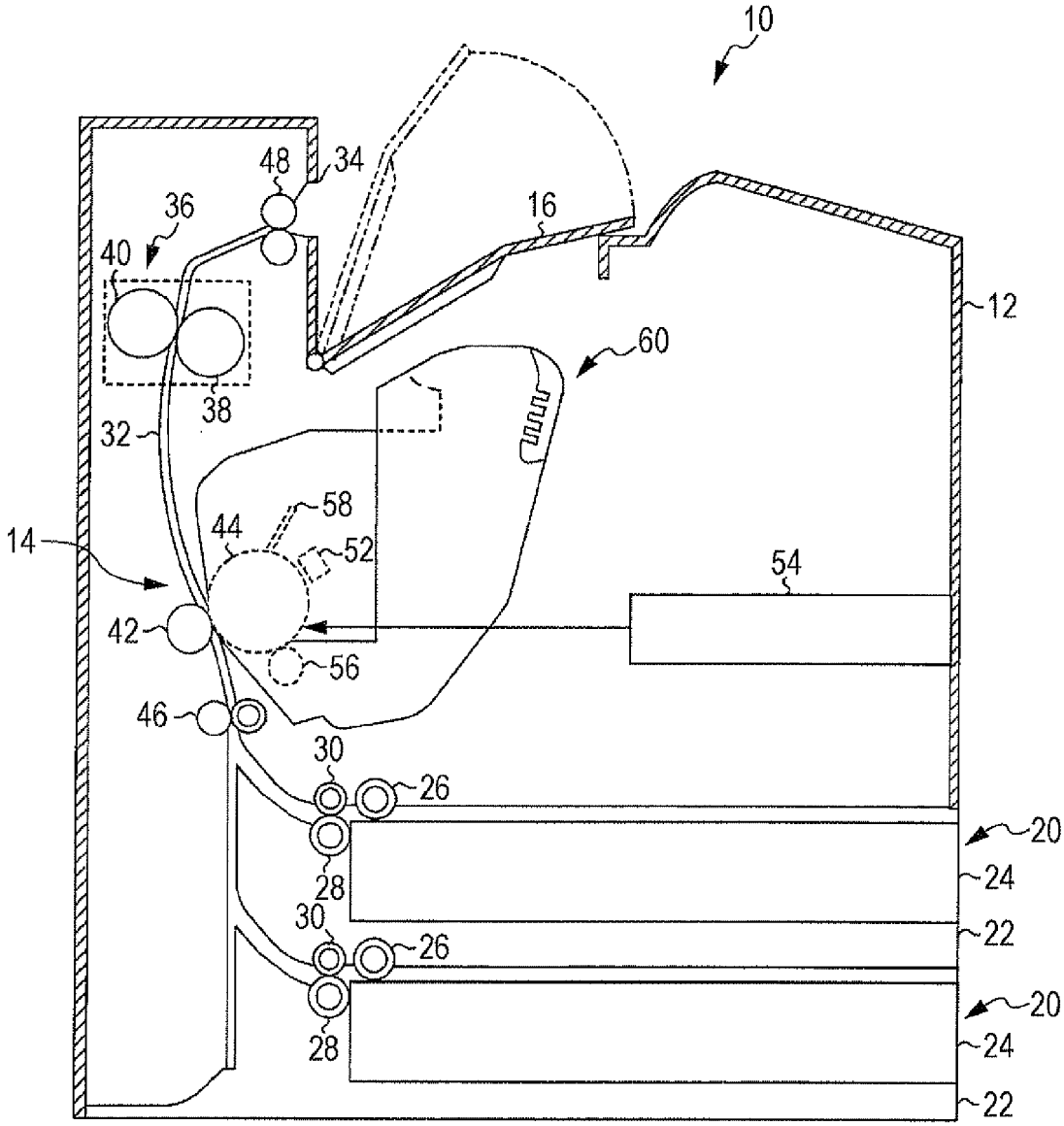
FIG. 1 is a schematic diagram illustrating an image forming apparatus to which a first exemplary embodiment of the present invention is applied.

FIG. 1 illustrates an overall configuration of an image forming apparatus 10 according to a first exemplary embodiment of the present invention.

The image forming apparatus 10 includes a housing 12. An image forming unit 14 is mounted inside the housing 12. An ejection unit 16 is provided on the top portion of the housing 12. Under the bottom portion of the housing 12, for example, sheet feeding devices 20 that are provided at two stages are disposed. Below the housing 12, further multiple sheet feeding devices may be added and disposed.

Each of the sheet feeding devices 20 includes a sheet-feeding-device body 22 and a sheet feeding cassette 24 in which recording media are stored. A pickup roller 26 is provided above and close to the rear end of the sheet feeding cassette 24. A retard roller 28 is disposed behind the pickup roller 26. A feed roller 30 is disposed at a position at which the feed roller 30 faces the retard roller 28.

A transport path 32 is a path that extends from the feed roller 30 to an ejection hole 34 and that is used for a recording medium. The transport path 32 is provided close to the rear side (a face on the left side in FIG. 1) of the housing 12, and has a portion that is substantially vertically formed from the sheet feeding device 20, which is provided at the bottom end, to a fixing unit 36.

A heating roller 38 and a pressure roller 40 are provided in the fixing unit 36. A transfer roller 42 and an image carrier 44 that serves as a photoconductor are disposed on the upstream side of the fixing unit 36 along the transport path 32. A register roller 46 is disposed on the upstream side of the transfer roller 42 and the image carrier 44. An ejection roller 48 is disposed close to the ejection hole 34 along the transport path 32.

Accordingly, a recording medium that has been sent from the sheet feeding cassette 24 of the sheet feeding device 20 by the pickup roller 26 is handled by cooperation of the retard roller 28 and the feed roller 30. In this manner, a recording medium that is provided as a top sheet in the sheet feeding cassette 24 is transported to the transport path 32, and is stopped for a brief period of time by the register roller 46 so that timing is adjusted for the recording medium. The recording medium passes between the transfer roller 42 and the image carrier 44, and a developer image is transferred onto the recording medium.

The transferred developer image is fixed onto the recording medium by the fixing unit 36, and is ejected from the ejection hole 34 to the ejection unit 16 by the ejection roller 48.

The image forming unit 14 operates, for example, as an electrophotographic system. The image forming unit 14 includes the following: the image carrier 44; a charging device 52 that uniformly charges the image carrier 44; an optical writing device 54 that writes a latent image onto the image carrier 44, which has been charged by the charging device 52, using light; a developing device 56 that visualizes the latent image, which has been formed on the image carrier 44 by the optical writing device 54, using a developer, thereby obtaining a developer image; the transfer roller 42 that transfers the developer image, which has been obtained by the developing device 56, onto a recording medium; a cleaning device 58 that cleans the residual developer remaining on the image carrier 44 and that includes, for example, a blade; and the fixing unit 36 that fixes the developer image, which has been transferred onto the recording medium by the transfer roller 42, on the recording medium.

A process cartridge 60 is obtained by integrating, into one piece, the image carrier 44, the charging device 52, the developing device 56, and the cleaning device 58. With the process cartridge 60, the image carrier 44, the charging device 52, the developing device 56, and the cleaning device 58 can be exchanged as one piece. The ejection unit 16 is opened, and then, the process cartridge 60 can be taken out from the housing 12.

Next, the details of the charging device 52 will be described.

Figure 2:
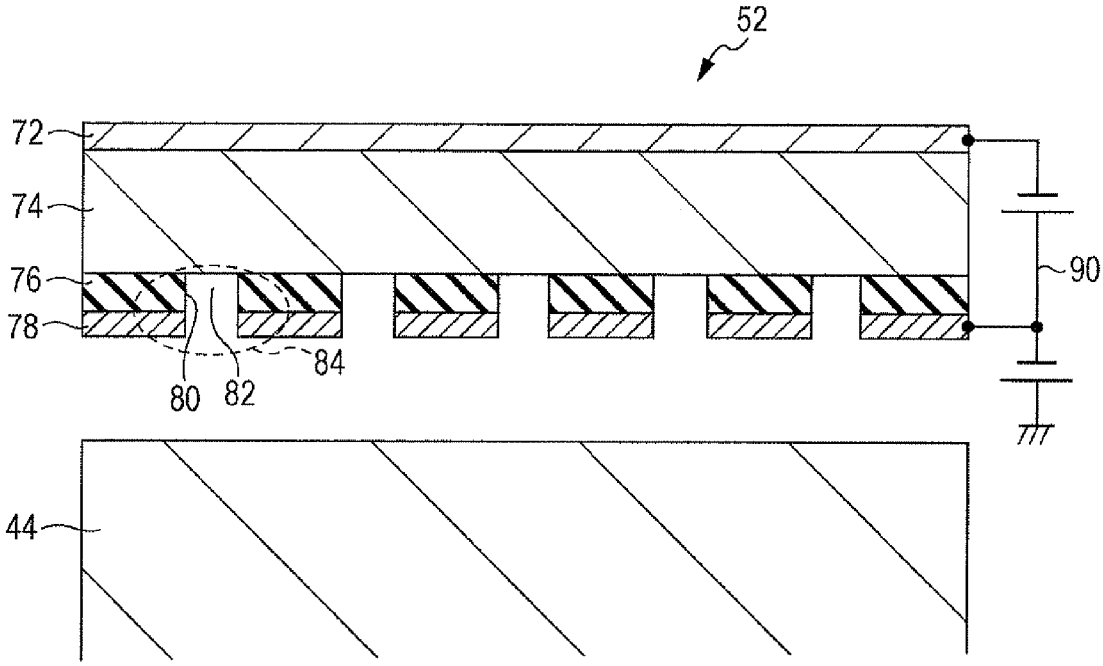
FIG. 2 is a cross sectional view of a charging device to which the first exemplary embodiment of the present invention is applied and a structure of portions surrounding the charging device.
Figure 3:
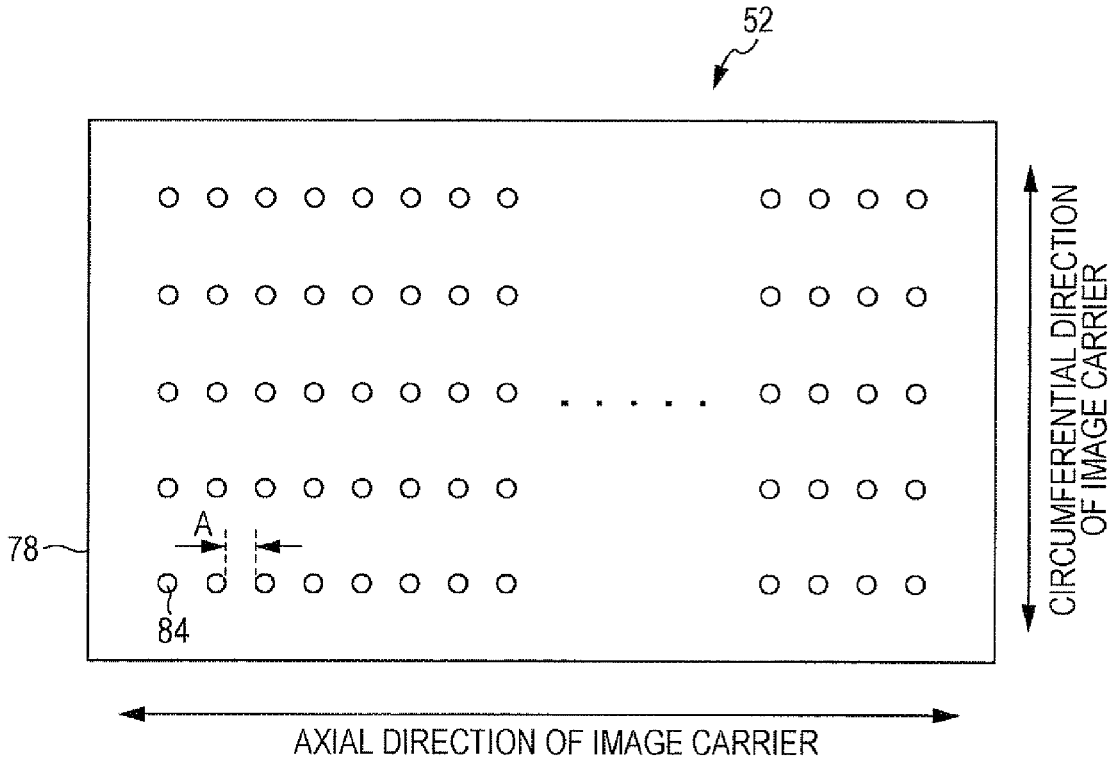
FIG. 3 is a diagram illustrating the bottom face of the charging device to which the first exemplary embodiment of the present invention is applied.

FIG. 2 is a cross sectional view of the charging device 52 and a structure of portions surrounding the charging device 52. FIG. 3 illustrates the bottom face (a face on the image carrier 44 side) of the charging device 52.

The charging device 52 has a configuration in which a conductive base material 72, a resistive layer 74, an insulating layer 76, and a conductive layer 78 are arranged in this order from the layer farthest from the image carrier 44 that faces the charging device 52.

A first electrode is formed of the conductive base material 72 and the resistive layer 74. A second electrode is formed of the conductive layer 78.

Openings 80 are provided in the conductive layer 78. Region limiting spaces 82 are provided in the insulating layer 76, and each of the region limiting spaces 82 is a space that is continuous with a corresponding one of the openings 80. The region limiting space 82 is formed so as to open in a direction in which the region limiting space 82 faces the image carrier 44, e.g., is formed in a cylindrical shape. As described above, the region limiting space 82 is a space that opens in a direction in which the region limiting space 82 is oriented toward the opening 80, and that is limited in a direction perpendicular to the above-mentioned direction.

A discharge region 84 includes the opening 80 and the region limiting space 82.

A direction in which the conductive base material 72, the resistive layer 74, the insulating layer 76, and the conductive layer 78 are arranged is, hereinafter, referred to as a "stacking direction" in some cases. Furthermore, a direction perpendicular to the stacking direction is, hereinafter, referred to as a "horizontal direction" in some cases.

A voltage applying unit 90 that applies a voltage to each of the conductive base material 72 and the conductive layer 78 is connected thereto.

When voltages equal to or higher than fixed voltages are applied to the conductive base material 72 and the conductive layer 78, discharge occurs in the discharge region 84 that is spatially limited by being surrounded by the resistive layer 74, the insulating layer 76, and the conductive layer 78.

Since the discharge region 84 is spatially limited in a direction (the horizontal direction) that is parallel to the image carrier 44, the discharge region 84 two-dimensionally limits discharge.

The discharge region 84 opens in a direction in which the discharge region 84 faces the image carrier 44. Accordingly, due to the potential difference between the conductive layer 78 and the image carrier 44, some charged particles (ions) that have been generated by discharge pass through the opening 80 of the conductive layer 78, and move to the image carrier 44 side. In other words, a configuration is provided, in which ions that have been generated in the discharge region 84 drift due to an electric field from the resistive layer 74 to the image carrier 44, thereby charging the image carrier 44. Here, the term "drifting" refers to movement of ions due to an electric field.

The conductive layer 78 adjusts, using an applied voltage, the intensity of the electric field for causing ions to move to the image carrier 44, and simultaneously has a function of adjusting the charge potential of the image carrier 44.

Next, the individual elements of the charging device 52 will be described.

As a material that the conductive base material 72 is formed of, a metal such as stainless, aluminum, a copper alloy, an alloy of metals among the above-mentioned metals, or an iron that is subjected to surface treatment with chrome, nickel, or the like is used.

The resistive layer 74 is formed to have a thickness that is in a range of 10 μm or larger.

From the viewpoint of obtaining an effect (hereinafter, referred to as a "discharge-current limiting effect" in some cases) of limiting discharge current using resistance, the resistance value of the resistive layer 74, which is calculated from a formula "a volume resistivity×the thickness of a resistive layer/a unit area", may be adjusted by reducing the thickness of the resistive layer 74 and by selecting a material having a high resistivity. However, in a case in which the thickness of the resistive layer 74 is smaller than 10 μm, a voltage withstanding property (a withstand voltage) for an applied voltage is reduced, so that the frequency of shorting of the resistive layer 74 in a case of discharge increases.

In a case in which the resistive layer 74 is formed so that the thickness of the resistive layer 74 is in a range of 100 μm or larger, compared with a case in which the thickness of the resistive layer 74 is in a range of smaller than 100 μm, a sufficient withstand voltage is obtained, and a temporal stability for application of high voltages is ensured.

A material that the insulating layer 76 is formed of is not limited to an organic material or an inorganic material. In a case in which a material that the insulating layer 76 is formed of is a solid material having a volume resistivity of $1\times10^{12}$ Ωcm or higher, compared with a case in which the volume resistivity is lower than $1\times10^{12}$ Ωcm, an excellent insulating property is obtained between both of the electrodes (the resistive layer 74 and the conductive layer 78) when high voltages are applied to the electrodes, and the shape of the discharge region 84 is stably maintained without being deformed over time.

The insulating layer 76 is formed to have a thickness that is in a range of 4 μm to 200 μm.

In the present exemplary embodiment, the region limiting space 82 is formed so as to penetrate through the insulating layer 76. Accordingly, the thickness of the insulating layer 76 limits the distance between both of the electrodes (the resistive layer 74 and the conductive layer 78), i.e., a discharge distance. In other words, the thickness of the insulating layer 76 corresponds to the length of the region limiting space 82 in the stacking direction.

When the discharge distance is reduced by setting the thickness of the insulating layer 76 to be 200 μm or smaller, regional concentration of discharge and sharp increase in discharge current are reduced, so that continuous discharge readily occurs.

When the discharge distance is made much larger than the mean free path (about 0.1 μm) of electrons in the air by setting the thickness of the insulating layer 76 to be 4 μm or larger, the frequency of ionization in the region limiting space 82 is ensured, so that continuous discharge readily occurs.

Furthermore, according to Paschen's law defining a discharge start voltage applied between parallel flat plates in the air or under the atmospheric pressure, when a spacing is about 4 μm, the discharge start voltage has a minimum value. When the spacing is smaller than 4 μm, the discharge start voltage increases. This indicates that, when the thickness of the insulating layer 76 is smaller than 4 μm, discharge does not readily occur.

In a case in which the thickness of the insulating layer 76 is in a range of 50 μm to 150 μm, compared with a case in which the thickness of the insulating layer 76 is not in the range of 50 μm to 150 μm, an insulating property that is obtained between the electrodes or uniform discharge is more stably maintained for application of high voltages to the electrodes.

As a material that the conductive layer 78 is formed of, a material having a volume resistivity of 0.1 Ωcm or lower is used.

The conductive layer 78 is formed to have a thickness that is in a range of 1 μm to 50 μm.

When the thickness of the conductive layer 78 is larger than 50 μm, the efficiency with which charged particles are caused to move from the opening 80 to the image carrier 44 does not sufficiently increase.

When the thickness of the conductive layer 78 is smaller than 1 μm, the electrodes are readily damaged due to conduction of electricity in a case of discharge.

As a material that the conductive layer 78 is formed of, a metal that is not readily contaminated by discharge gas is used. For example, a metallic material such as tungsten, molybdenum, carbon, platinum, copper, or aluminum, or a material that is obtained by performing surface treatment, such as gold-plating, on one of the above-mentioned metallic materials is used.

The structure of the discharge region 84 that limits a discharge space is determined in accordance with the inner diameter of the region limiting space 82 and the opening 80, which penetrate through the insulating layer 76 and the conductive layer 78, respectively, and in accordance with the thicknesses of the insulating layer 76 and the conductive layer 78.

The region limiting space 82 and the opening 80 are formed to have an inner diameter that is in a range of 4 μm to 200 μm.

Here, the term "inner diameter" refers to a length (a diameter) of the inside of the region limiting space 82 and the opening 80 in the horizontal direction.

When the inner diameter is larger than 200 μm, a calculation result that the intensity of each of electric fields which are generated at the edge (rim) of the opening 80 or at portions surrounding the opening 80 is several times or more higher than that of an electric field which is generated at the center of a space in the discharge region 84 is obtained using typical analytical calculation for an electrostatic field. When the electric field distribution in the region limiting space 82 becomes non-uniform and discharge is concentrated at the portions surrounding the opening 80, as a result, discharge becomes unstable, so that the amount of generated ozone may increase or the resistive layer 74 may be shorted.

When the inter diameter is equal to or smaller than 200 μm, equipotential surfaces are formed to an extent that the equipotential surfaces are approximately parallel to an insulating material. Accordingly, the electric field distribution in the discharge region 84 becomes uniform, so that stable discharge readily occurs over the discharge region 84.

When the inner diameter is smaller than 4 μm, the amount of charged particles generated by discharge per discharge region 84 decreases. Accordingly, in order to more efficiently charge the image carrier 44 so that the image carrier 44 has a target potential, the inner diameter may be equal to or larger than 4 μm.

In a case in which the inner diameter of the discharge region 84 is in a range of 50 μm to 150 μm, compared with a case in which the inner diameter is not in the range of 50 μm to 150 μm, uniform discharge occurs over the entire discharge region 84 with a high efficiency.

The charging device 52 charges the image carrier 44 using movement (drifting) of charged particles due to an electric field. Accordingly, the charging device 52 is disposed at a certain position, and, at the certain position, a distance at which discharge does not occur between the conductive layer 78, which is disposed closer to the image carrier 44, and the image carrier 44 is maintained.

More specifically, the charging device 52 is disposed so that a distance (a nearest neighbor distance) at which the conductive layer 78 is closest to the image carrier 44 is equal to or longer than 300 μm and equal to or shorter than 2 mm.

When the nearest neighbor distance between the conductive layer 78 and the image carrier 44 is longer than 2 mm, the charge efficiency decreases.

When the nearest neighbor distance between the conductive layer 78 and the image carrier 44 is shorter than 300 μm, discharge readily occurs between the conductive layer 78 and the image carrier 44, so that a load is applied to the image carrier 44. For example, it is supposed that a voltage of "−2 kV" is applied to the resistive layer 74 and a voltage of "−750 V" is applied to the conductive layer 78 for a voltage of "−700 V" that is a target charge potential of the image carrier 44. In this case, when the nearest neighbor distance is shorter than 300 μm, according to estimation of a discharge start voltage that is obtained using Paschen's law, there is a possibility that charged particles move from the resistive layer 74 and pass through the conductive layer 78, and that discharge of the charged particles to the image carrier 44 occurs.

In order that the image carrier 44 have a uniform potential without having a non-uniform potential in streaks influenced by ions that have moved from the discharge region 84 to the top of the image carrier 44 due to an electric field, a distance A (see FIG. 3) between the discharge regions 84 adjacent to each other in the axial direction of the image carrier 44 is set to be at least as short as or equal to or shorter than the distance between the conductive layer 78 and the image carrier 44.

The number of lines of the discharge regions 84 in the circumferential direction of the image carrier 44 is adjusted so that a necessary charge capability can be ensured in accordance with a process speed.

For example, the discharge regions 84 are formed in a line at intervals of 300 μm so as to be parallel to the rotation-axis direction of the image carrier 44, and so as to have only a width necessary for charge. In order to improve the charge capability, similar five lines are arranged at intervals of 750 μm in the circumferential direction of the image carrier 44.

Next, the details of the resistive layer 74 will be described.

Figure 4:
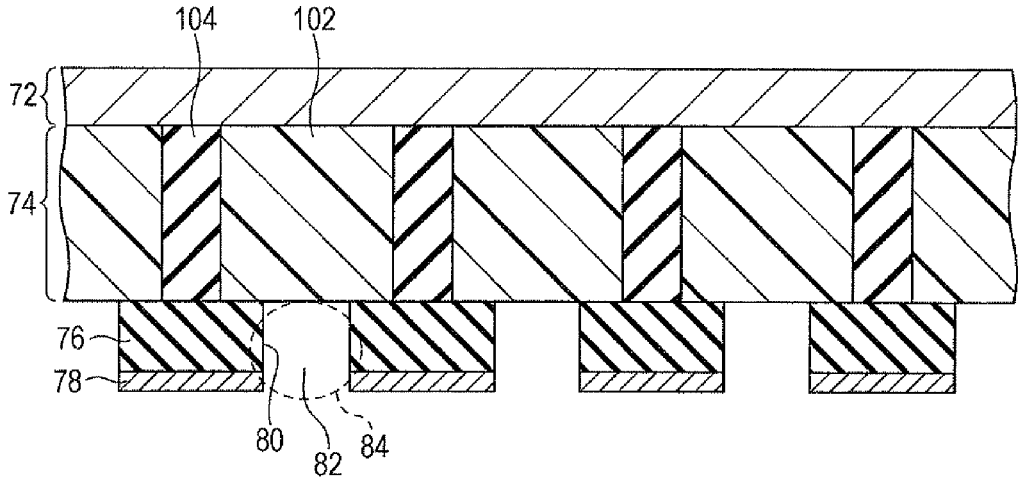
FIG. 4 is a cross sectional view of a discharge region and a structure of portions surrounding the discharge region.

FIG. 4 is a cross sectional view of the discharge region 84 and a structure of portions surrounding the discharge region 84.

Regarding the resistive layer 74, in a case in which the volume resistivity of the resistive layer 74 is comparatively high, the surface resistivity of the surface (interface) of the resistive layer 74 that is in contact with the discharge region 84 is also high. Accordingly, regarding discharge that occurs in portions of each of the discharge regions 84, discharge that occurs in each of the portions is separated from discharge that occurs in the other portions. Uniform discharge readily occurs in the entire portion of each of the discharge regions 84.

However, when the length (thickness) of the resistive layer 74 in the stacking direction is set to be comparatively small (for example, be shorter than 10 μm) in order to adjust the discharge-current limiting effect using the resistance of the resistive layer 74, the voltage withstanding property of the resistive layer 74 is reduced, so that the frequency of shorting of the resistive layer 74 increases.

The term "volume resistivity" refers to a value (Ωcm) that is obtained by dividing the intensity of a direct-current electric field generated in a measurement target by a current density that is in a stationary state. The term "surface resistivity" refers to a value (Ω) that is obtained by dividing the intensity of a direct-current electric field generated in a surface layer of a measurement target by a current per unit length of an electrode. Measurement methods are defined, for example, in JIS standard C213.

In contrast, in order to reduce the frequency of shorting of the resistive layer 74, a method for increasing the thickness of the resistive layer 74 is considered. In order to increase the thickness of the resistive layer 74 while a similar discharge-current limiting effect is maintained (while the resistance value in the stacking direction is maintained), the volume resistivity of the resistive layer 74 needs to be reduced. In other words, the resistive layer 74 is formed to have a thickness that is N times the original and to have a volume resistivity that is 1/N-th of the original.

However, in a case in which the volume resistivity of the resistive layer 74 is comparatively low, the surface resistivity of the surface (interface) of the resistive layer 74 that is in contact with the discharge regions 84 is also low. Accordingly, regarding discharge that occurs in portions of each of the discharge regions 84, discharge that occurs in each of the portions is not readily separated from discharge that occurs in the other portions, and discharge becomes readily concentrated at specific portions. Furthermore, resistance components in each of the discharge regions 84 are not readily oriented in parallel, so that discharge is readily influenced by variation in the discharge start voltage in the surrounding discharge regions 84.

Accordingly, when discharge has started in one of the discharge regions 84, discharge current flows toward the discharge region 84. In the surrounding discharge regions 84 that surround the discharge region 84, voltage drop occurs, so that discharge does not readily occur.

As illustrated in FIG. 4, in the present exemplary embodiment, the resistive layer 74 includes resistors 102 and insulating materials 104. The resistors 102 and the insulating materials 104 are individually disposed so as to extend from the conductive base material 72 side to the discharge region 84 side in the stacking direction.

An anisotropic conductive portion is formed of the resistors 102 and the insulating materials 104.

Each of the resistors 102 is provided so as to correspond to one of the discharge regions 84. For example, the length of the resistor 102 in the horizontal direction is larger than that of the discharge region 84 in the horizontal direction.

The insulating materials 104 are provided so as to separate the resistors 102 from each other on a discharge-region-84-by-discharge-region-84 basis. For example, the length of the insulating material 104 is smaller than that of the insulating layer 76 and the conductive layer 78 in the horizontal direction.

As described above, the resistive layer 74 has a structure in which the resistors 102 are separated from each other by the insulating materials 104 so that each of the resistors 102 corresponds to one of the discharge regions 84.

Each of the resistors 102 and each of the insulating materials 104 are formed so that the resistivity of the resistor 102 is lower than the resistivity of the insulating material 104. Accordingly, the resistive layer 74 has anisotropy in which a resistance component in the stacking direction is smaller than a resistance component in the horizontal direction.

The resistive layer 74 has a structure in which current flowing through the resistor 102 readily flows into the corresponding discharge region 84 (in the stacking direction) and does not readily flow into the surrounding discharge regions 84, which do not correspond to the resistor 102 (in the horizontal direction).

The resistor 102 is formed to have a volume resistivity that is in a range of $1\times10^{6}$ Ωcm to $1\times10^{10}$ Ωcm.

When the volume resistivity of the resistor 102 is higher than $1\times10^{10}$ Ωcm, discharge that occurs between the electrodes tends to be insufficient. Discharge may occur at random in the region limiting space 82 which is a discharge space, so that it may be difficult to achieve stable discharge.

When the volume resistivity of the resistor 102 is lower than $1\times10^{6}$ Ωcm, the discharge-current limiting effect is not sufficiently obtained, and discharge is regionally concentrated in the surface of the resistive layer 74 (the resistor 102) that corresponds to the region limiting space 82. As a result, discharge current may become unstable or excessive, and this may lead to rapid degradation of materials, shorting of the resistive layer 74, or the like.

In a case in which the volume resistivity of the resistor 102 is in a range of $1\times10^{6}$ Ωcm to $1\times10^{9}$ Ωcm, compared with a case in which the volume resistivity of the resistor 102 is not in the range of $1\times10^{6}$ Ωcm to $1\times10^{9}$ Ωcm, more stable discharge continues in the discharge region 84.

As the resistor 102, a material that is obtained by dispersing conductive particles or semiconducting particles in a resin material or a rubber material is used.

For example, a polyester resin, an acrylic resin, a melamine resin, an epoxy resin, a urethane resin, a silicone resin, a urea resin, a polyamide resin, a polyimide resin, a polycarbonate resin, a styrene resin, an ethylene resin, a synthetic resin of resin materials among the above-mentioned resin materials is used as the resin material.

Ethylene propylene rubber, polybutadiene, natural rubber, polyisobutylene, chloroprene rubber, silicon rubber, urethane rubber, epichlorohydrin rubber, fluorosilicone rubber, ethylene oxide rubber, a foaming agent that is obtained by foaming a rubber material among the above-mentioned rubber materials, or a mixture of rubber materials among the above-mentioned rubber materials is used as the rubber material.

As the conductive particles or the semiconducting particles, a metal such as carbon black, zinc, aluminum, copper, iron, nickel, chromium, or titanium, a metallic oxide such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, or MgO, an ionic compound such as a quaternary ammonium salt, or a mixture of one type of or two or more types of materials among the above-mentioned materials is used.

In addition, the resistor 102 may be formed of not only an organic material such as a resin or rubber, but also a semiconducting glass that is obtained by dispersing conductive particles in a glass, an aluminum porous anodic oxide film, or the like.

The insulating material 104 is formed to have a volume resistivity that is in a range of $1\times10^{12}$ Ωcm or higher.

In a case in which the insulating material 104 is a solid material having a volume resistivity that is in the range of $1\times10^{12}$ Ωcm or higher, compared with a case in which the volume resistivity of the insulating material 104 is lower than $1\times10^{12}$ Ωcm, an excellent insulating property in the horizontal direction is obtained, so that the flow of discharge current into the surrounding discharge regions 84 other than the corresponding discharge region 84 is reduced.

The resistive layer 74 is adjusted so that the resistance value (which is a value calculated from a formula a volume resistivity×the thickness of a resistive layer/an area wherein the area is an area of a circle having a diameter of 100 μm) of the resistor 102 in the staking direction is in a range of $1\times10^{8}$Ω to $1\times10^{11}$Ω while the volume resistivity of the resistor 102 satisfies the appropriate range of $1\times10^{7}$ Ωcm to $1\times10^{9}$ Ωcm, the volume resistivity of the insulating material 104 satisfies the appropriate range of $1\times10^{12}$ Ωcm or higher, and the thickness of the resistive layer 74 satisfies the appropriate range of 100 μm or larger. In this case, both the discharge-current limiting effect using resistance components and the temporal stability that is obtained by ensuring a certain thickness are achieved.

The structure in the present exemplary embodiment is formed, for example, using a production method given below.

First, in a layer of alumina (aluminum oxide) (the insulating materials 104), holes having a diameter of 300 μm are formed at intervals of 400 μm by punching or the like. Then, a resistance agent (the resistors 102) that is obtained by dispersing an appropriate amount of carbon in polyimide is applied so that the holes are filled with the resistance agent, and dried and baked, thereby forming the resistive layer 74.

A conductive paste (the conductive base material 72) is applied onto one face of the resistive layer 74. As the conductive paste, for example, a silver paste is used.

The insulating layer 76 and the conductive layer 78, in which the discharge regions 84 have been formed using a printed board technique or the like, are caused to come into contact with and are fixed onto the other face of the resistive layer 74. Note that the insulating layer 76 and the conductive layer 78, in which the discharge regions 84 have been provided, may be directly formed on the resistive layer 74 using a screen printing technique or the like.

In a case in which the resistive layer 74 has anisotropy of resistance components, the apparent resistivity in the horizontal direction is higher than that in the stacking direction. Accordingly, the surface resistivity of the resistive layer 74 is higher than the surface resistivity of the resistive layer 74 in a case in which the resistive layer 74 does not anisotropy of resistance components.

In a case in which the resistive layer 74 has anisotropy of resistance components, compared with a case in which the resistive layer 74 does not have anisotropy of resistance components, regarding each of the discharge regions 84, current that flows from a range corresponding to the surrounding discharge regions 84 into the discharge region 84 can be neglected, and an influence of variation in the discharge start voltage in the individual discharge regions 84 is reduced.

Second Exemplary Embodiment

Next, a second exemplary embodiment will be described.

Figure 5:
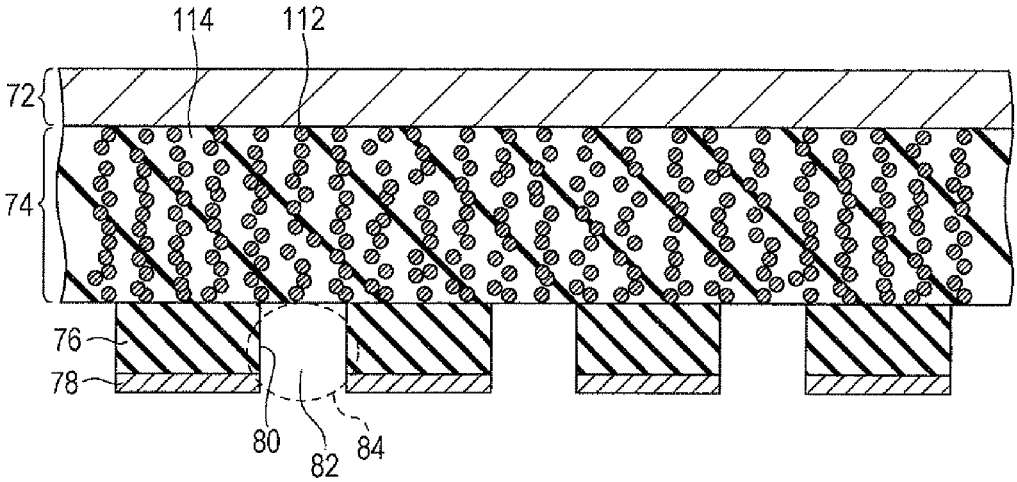
FIG. 5 is a cross sectional view of the discharge region and a structure of portions surrounding the discharge region in a second exemplary embodiment.
Figure 6A:
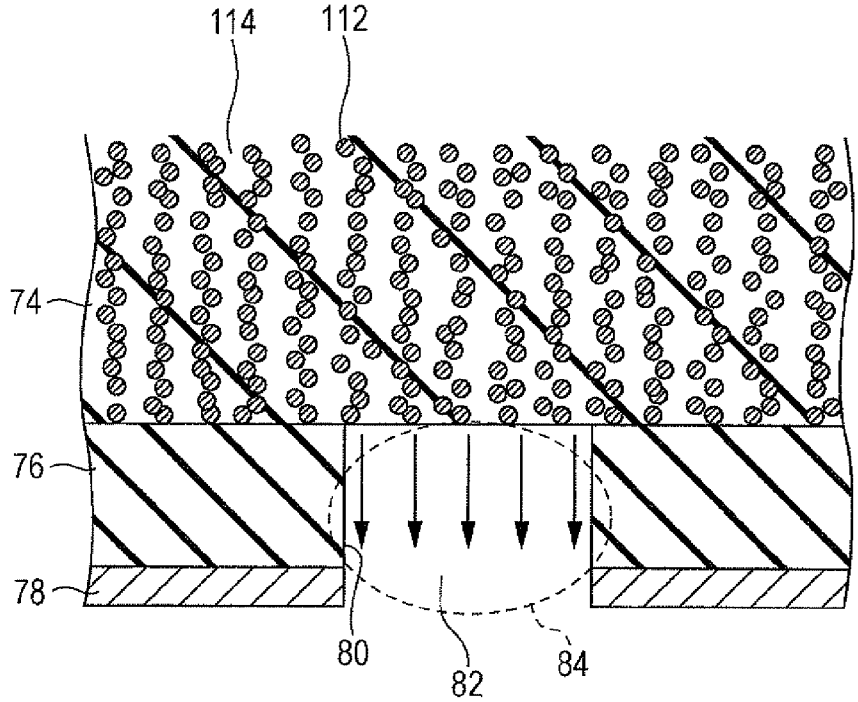
FIGS. 6A and 6B are enlarged views of the discharge region in the second exemplary embodiment.
Figure 6B:
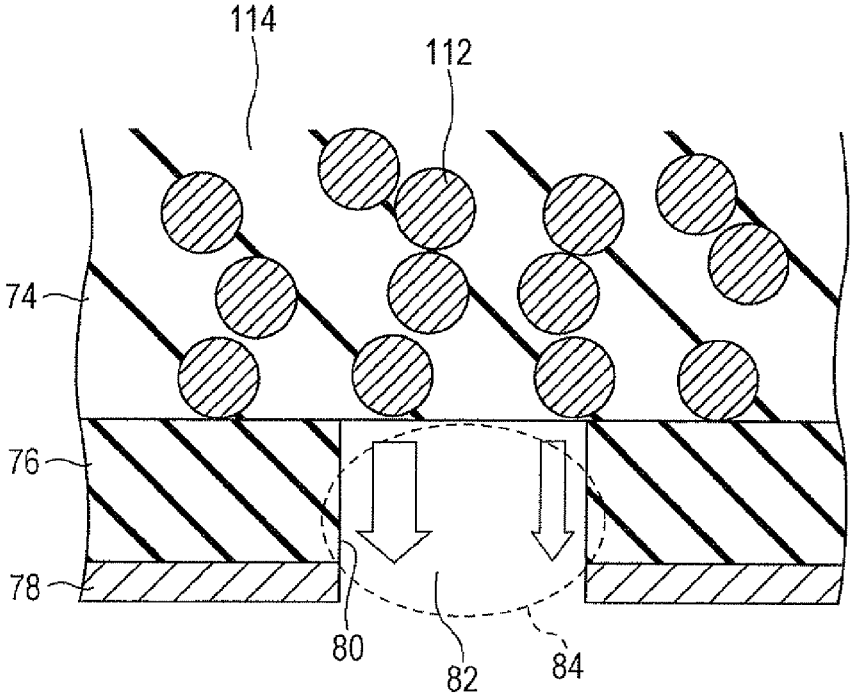

FIG. 5 is a cross sectional view of the discharge region 84 and a structure of portions surrounding the discharge region 84 in the second exemplary embodiment. FIGS. 6A and 6B are enlarged views of the discharge region 84. FIG. 6A illustrates a case in which the particle diameter of conductive particles 112 is sufficiently smaller than the inner diameter of the discharge region 84. FIG. 6B illustrates a case in which the particle diameter of the conductive particles 112 is not sufficiently smaller than the inner diameter of the discharge region 84.

As illustrated in FIG. 5, in the second exemplary embodiment, the resistive layer 74 has a structure in which the conductive particles 112 are dispersed in an entire insulating material 114. The conductive particles 112 are dispersed so as to be unevenly distributed and to extend in the stacking direction from the conductive base material 72 side to the discharge region 84 side.

In the present exemplary embodiment, an anisotropic conductive portion is formed using the conductive particles 112 and the insulating material 114.

The conductive particles 112 and the insulating material 114 are formed so that the resistivity of the conductive particles 112 is lower than the resistivity of the insulating material 114. Accordingly, the resistive layer 74 has anisotropy in which a resistance component in the stacking direction is smaller than a resistance component in the horizontal direction.

In the present exemplary embodiment, in a case in which the volume resistivity of the resistive layer 74 is in a range of $1\times10^{6}$ Ωcm to $1\times10^{9}$ Ωcm, compared with a case in which the volume resistivity of the resistive layer 74 is not in the range of $1\times10^{6}$ Ωcm to $1\times10^{9}$ Ωcm, more stable discharge continues in the discharge region 84.

Regarding resistance components of the resistive layer 74, in a case in which a resistance component in the horizontal direction is equal to or larger than five times a resistance component in the stacking direction, compared with a case in which the resistance component in the horizontal direction is smaller than five times the resistance component in the stacking direction, regarding each of the discharge regions 84, current that flows from a range corresponding to the surrounding discharge regions 84 into the discharge region 84 can be neglected, and an influence of variation in the discharge start voltage in the individual discharge regions 84 is reduced.

In a case in which the particle diameter of the conductive particles 112 is equal to or smaller than one-tenth the inner diameter of the discharge region 84, compared with a case in which the particle diameter of the conductive particles 112 is larger than one-tenth the inner diameter of the discharge region 84, uniform discharge readily occurs over the discharge region 84 with more stability.

The term "particle diameter" refers to a diameter of particles in a case in which the particles are considered as spheres.

In a case in which the particle diameter of the conductive particles 112 is sufficiently smaller than the inner diameter of the discharge region 84 (FIG. 6A), compared with a case in which the particle diameter of the conductive particles 112 is not sufficiently smaller than the inner diameter of the discharge region 84 (FIG. 6B), the surface of the resistive layer 74 that is in contact with the discharge region 84 is in a state in which portions at which discharge current is generated are evenly distributed for the discharge region 84.

Accordingly, in a case in which the particle diameter of the conductive particles 112 is sufficiently smaller than the inner diameter of the discharge region 84, concentration of discharge at specific portions in the discharge region 84 is reduced.

Thus, uniform discharge readily occurs in the discharge region 84 with more stability. In a case in which uniform discharge occurs in the discharge region 84, compared with a case in which uniform discharge does not occur in the discharge region 84, ions that have been generated by discharge are caused to readily move to a side of a member to be charged.

The insulating material 114 is formed to have a volume resistivity that is in a range of $1\times10^{12}$ Ωcm or higher.

In a case in which the insulating material 114 is a solid material having a volume resistivity that is in the range of $1\times10^{12}$ Ωcm or higher, compared with a case in which the volume resistivity of the insulating material 114 is lower than $1\times10^{12}$ Ωcm, an excellent insulating property in the horizontal direction is obtained, so that the flow of discharge current into the surrounding discharge regions 84 other than the corresponding discharge region 84 is reduced.

The structure in the present exemplary embodiment is formed, for example, using a production method given below.

Magnetic conductive microparticles (the conductive particles 112) such as nickel particles are dispersed in liquid silicone rubber (the insulating material 114) containing a thermosetting agent. The liquid silicone rubber is cured by heating while a magnetic filed is being applied to the liquid silicone rubber.

Alternatively, silver particles or the like as the conductive particles 112 are evenly dispersed in a thermosetting resin that the insulating material 114 is formed of. Next, the thermosetting resin is cured by heating while a pressure is applied to the thermosetting resin in the stacking direction.

With any one of the above-mentioned production methods, the resistive layer 74 in which the conductive particles 112 are dispersed in the insulating material 114 so as to be unevenly distributed (in columns) in the stacking direction, and which has anisotropy in the stacking direction is formed.

A conductive paste (the conductive base material 72) is applied onto one face of the resistive layer 74 that has been formed in this manner. The insulating layer 76 and the conductive layer 78 in which the discharge regions 84 have been provided are formed on the other face of the resistive layer 74.

Note that the conductive base material 72, and the insulating layer 76 and the conductive layer 78 may be caused to come into contact with and may be fixed onto one face of the resistive layer 74 and the other face of the resistive layer 74, respectively, simultaneously with a heat-curing process in a case of forming the resistive layer 74.

As described in the present exemplary embodiment, in a case in which the resistive layer 74 is formed by dispersing the conductive particles 112 in the insulating material 114 and by curing the insulating material 114 as one solid by heating, the production process is simplified, compared with a case in which a resistance portion and an insulating portion are formed separately from each other. Furthermore, the production cost is reduced.

Third Exemplary Embodiment

Next, a third exemplary embodiment will be described.

Figure 7:
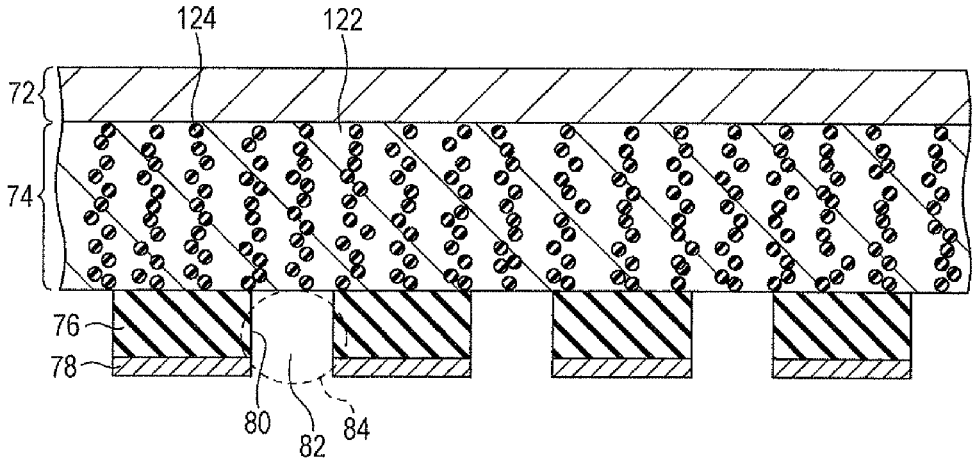
FIG. 7 is a cross sectional view of the discharge region and a structure of portions surrounding the discharge region in a third exemplary embodiment.

FIG. 7 is a cross sectional view of the discharge region 84 and a structure of portions surrounding the discharge region 84 in the third exemplary embodiment.

In the third exemplary embodiment, the resistive layer 74 has a structure in which insulating particles 124 are dispersed in an entire resistor 122. The insulating particles 124 are dispersed so as to be unevenly distributed and to extend in the stacking direction from the conductive base material 72 side to the discharge region 84 side.

In the present exemplary embodiment, an anisotropic conductive portion is formed using the resistor 122 and the insulating particles 124.

The resistor 122 and the insulating particles 124 are formed so that the resistivity of the resistor 122 is lower than the resistivity of the insulating particles 124. Accordingly, the resistive layer 74 has anisotropy in which a resistance component in the stacking direction is smaller than a resistance component in the horizontal direction.

In the present exemplary embodiment, in a case in which the volume resistivity of the resistive layer 74 is in a range of $1\times10^{6}$ Ωcm to $1\times10^{9}$ Ωcm, compared with a case in which the volume resistivity of the resistive layer 74 is not in the range of $1\times10^{6}$ Ωcm to $1\times10^{9}$ Ωcm, more stable discharge continues in the discharge region 84.

Regarding resistance components of the resistive layer 74, in a case in which a resistance component in the horizontal direction is equal to or larger than five times a resistance component in the stacking direction, compared with a case in which the resistance component in the horizontal direction is smaller than five times the resistance component in the stacking direction, regarding each of the discharge regions 84, current that flows from a range corresponding to the surrounding discharge regions 84 into the discharge region 84 can be neglected, and an influence of variation in the discharge start voltage in the individual discharge regions 84 is reduced.

In a case in which the particle diameter of the insulating particles 124 is equal to or smaller than one-tenth the inner diameter of the discharge region 84, compared with a case in which the particle diameter of the insulating particles 124 is larger than one-tenth the inner diameter of the discharge region 84, uniform discharge readily occurs over the discharge region 84 with more stability.

The insulating particles 124 are formed to have a volume resistivity that is in a range of $1\times10^{12}$ Ωcm or higher.

In a case in which the insulating particles 124 are formed of a solid material having a volume resistivity that is in the range of $1\times10^{12}$ Ωcm or higher, compared with a case in which the volume resistivity of the insulating particles 124 is lower than $1\times10^{12}$ Ωcm, an excellent insulating property in the horizontal direction is obtained, so that the flow of discharge current into the surrounding discharge regions 84 other than the corresponding discharge region 84 is reduced.

As described in the present exemplary embodiment, in a case in which the resistive layer 74 is formed by dispersing the insulating particles 124 in the resistor 122 and by curing the resistor 122 as one solid by heating, the production process is simplified, compared with a case in which a resistance portion and an insulating portion are formed separately from each other. Furthermore, the production cost is reduced.

Fourth Exemplary Embodiment

Next, a fourth exemplary embodiment will be described.

Figure 8:
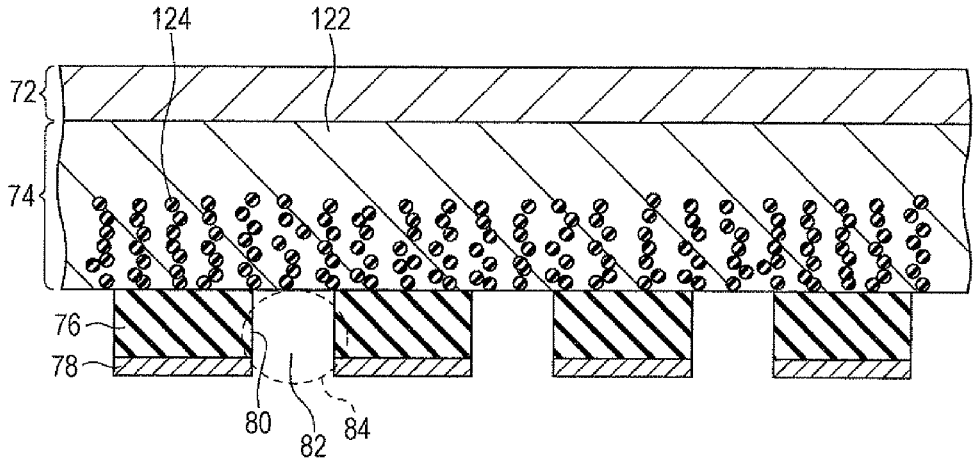
FIG. 8 is a cross sectional view of the discharge region and a structure of portions surrounding the discharge region in a fourth exemplary embodiment.

FIG. 8 is a cross sectional view of the discharge region 84 and a structure of portions surrounding the discharge region 84 in the fourth exemplary embodiment.

In the fourth exemplary embodiment, the resistive layer 74 has a structure in which insulating particles 124 are dispersed on the discharge region 84 side in the entire resistor 122 so as to be close to the discharge region 84.

In the third exemplary embodiment, the insulating particles 124 are dispersed so as to be unevenly distributed from the conductive base material 72 side to the discharge region 84 side in the entire resistor 122. In contrast, the fourth exemplary embodiment is different from the third exemplary embodiment in that the insulating particles 124 are not dispersed on the conductive base material 72 side.

In other words, in the present exemplary embodiment, the resistor 122 has a structure in which an anisotropic conductive portion is formed on the discharge region 84 side so as to be close to the discharge region 84.

The insulating particles 124 are dispersed on the discharge region 84 side, for example, in a range of substantially half the thickness of the resistive layer 74 or smaller.

In a case in which the resistive layer 74 has the structure in which the insulating particles 124 are dispersed on the discharge region 84 side so as to be close to the discharge region 84, the production cost is reduced, compared with a case in which the resistive layer 74 does not have the present structure.

In the above-described exemplary embodiments, examples of application of the present invention to the charging device of the image forming apparatus are described. The present invention is not limited thereto. The present invention may also be applied as a charged particle generator to the following examples of usage:

a de-charge treatment for, in a process of producing an electronic device or the like, neutralizing generated charges by supplying charges having a reversed polarity so as to prevent the electronic device from being damaged due to static electricity caused by charging the electronic device;

a surface modification treatment of modifying a surface of a solid material (such as a hydrophilizing treatment or a hydrophobizing treatment);

a disinfection treatment or a sterilization treatment in food processing or medical fields; and air cleaning.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charged particle generator comprising:

a first electrode;

a second electrode; and an insulating material that is provided between the first electrode and the second electrode, wherein the second electrode has an opening that opens in a first direction in which the first electrode, the insulating material, and the second electrode are arranged, wherein the insulating material has a region limiting space, the region limiting space corresponds to the opening, the region limiting space is continuous with the opening, and the region limiting space is a space that opens in a direction in which the region limiting space is oriented toward the opening and that is limited in a second direction perpendicular to the first direction, and wherein the first electrode has an anisotropic resistance portion in which a resistance component in the first direction is smaller than a resistance component in the second direction.

2. The charged particle generator according to claim 1, wherein insulating particles are dispersed in the anisotropic resistance portion.

3. The charged particle generator according to claim 2, wherein the region limiting space is formed in a cylindrical shape, and wherein a particle diameter of the insulating particles is smaller than an inner diameter of the region limiting space.

4. The charged particle generator according to claim 1, wherein conductive particles are dispersed in the anisotropic resistance portion.

5. A charging device comprising:

a first electrode;

a second electrode that is disposed so as to face a member to be charged; and an insulating material that is provided between the first electrode and the second electrode, wherein the second electrode has an opening that opens, to the member to be charged, in a first direction in which the first electrode, the insulating material, and the second electrode are arranged, wherein the insulating material has a region limiting space, the region limiting space corresponds to the opening, the region limiting space is continuous with the opening, and the region limiting space is a space that opens in a direction in which the region limiting space is oriented toward the opening and that is limited in a second direction perpendicular to the first direction, and wherein the first electrode has an anisotropic resistance portion in which a resistance component in the first direction is smaller than a resistance component in the second direction.

6. An image forming apparatus comprising:

an image carrier;

a charging device that is disposed so as not to be in contact with the image carrier and that charges the image carrier;

a developing device that develops, using a developer, a latent image which has been formed by exposure on the image carrier charged by the charging device;

a transfer unit that transfers, onto a recording medium, the image which has been developed by the developing device; and a fixing unit that fixes, onto the recording medium, the image which has been transferred onto the recording medium by the transfer unit, the charging device comprising a first electrode, a second electrode that is disposed so as to face the image carrier, and an insulating material that is provided between the first electrode and the second electrode, wherein the second electrode has an opening that opens, to the image carrier, in a first direction in which the first electrode, the insulating material, and the second electrode are arranged, wherein the insulating material has a region limiting space, the region limiting space corresponds to the opening, the region limiting space is continuous with the opening, and the region limiting space is a space that opens in a direction in which the region limiting space is oriented toward the opening and that is limited in a second direction perpendicular to the first direction, and wherein the first electrode has an anisotropic resistance portion in which a resistance component in the first direction is smaller than a resistance component in the second direction.

* * * * *